United States Patent [19]

Scully

[11] 4,077,308

[45] Mar. 7, 1978

[54] CONTROL FOR BAG MAKING MACHINE

[75] Inventor: John W. Scully, Quincy, Mass.

[73] Assignee: Pneumatic Scale Corporation, Quincy, Mass.

[21] Appl. No.: 692,958

[22] Filed: Jun. 4, 1976

[51] Int. Cl.[2] ..... B31B 23/60

[52] U.S. Cl. ..... 93/19; 53/28; 53/180 M; 53/182 M; 93/33 H

[58] Field of Search ..... 93/33 H, 33 R, 8 R, 93/14, 17–20, 35 R, 34, 82, DIG. 1; 53/51, 28, 180 M, 182

[56] References Cited

U.S. PATENT DOCUMENTS

| | | | |
|---|---|---|---|
| 2,200,971 | 5/1940 | Sonneborn et al. | 93/82 X |
| 2,214,593 | 9/1940 | Mustin et al. | 53/28 X |
| 2,276,282 | 3/1942 | Bindszus | 53/28 |
| 3,015,922 | 1/1962 | Frank et al. | 93/82 X |
| 3,057,128 | 10/1962 | Gerhauser | 53/28 |
| 3,374,602 | 3/1968 | Hamilton | 53/51 |
| 3,557,525 | 1/1971 | Bauder | 93/33 R |

*Primary Examiner*—James F. Coan
*Attorney, Agent, or Firm*—Dike, Bronstein, Roberts, Cushman and Pfund

[57] ABSTRACT

Apparatus for making a succession of bags from a web of sheet material which has been printed with a series of spaced parallel bands of heat activatable adhesive located at intervals corresponding to the lengths of the bags to be made wherein the web is formed about a mandrel into a tube and advanced therealong to sealing instrumentalities situated forwardly of the mandrel in the direction of movement, a pair of endless belts paralleling the mandrel for advancing the tube along the mandrel toward the sealing instrumentalities and a detector responsive to the presence of a band of adhesive on the web and located at a place in the path of movement of the web which corresponds to a whole number of bag lengths from the sealing instrumentalities which controls the feeding means so as to feed one bag length at a time relative to the sealing instrumentalities.

7 Claims, 10 Drawing Figures

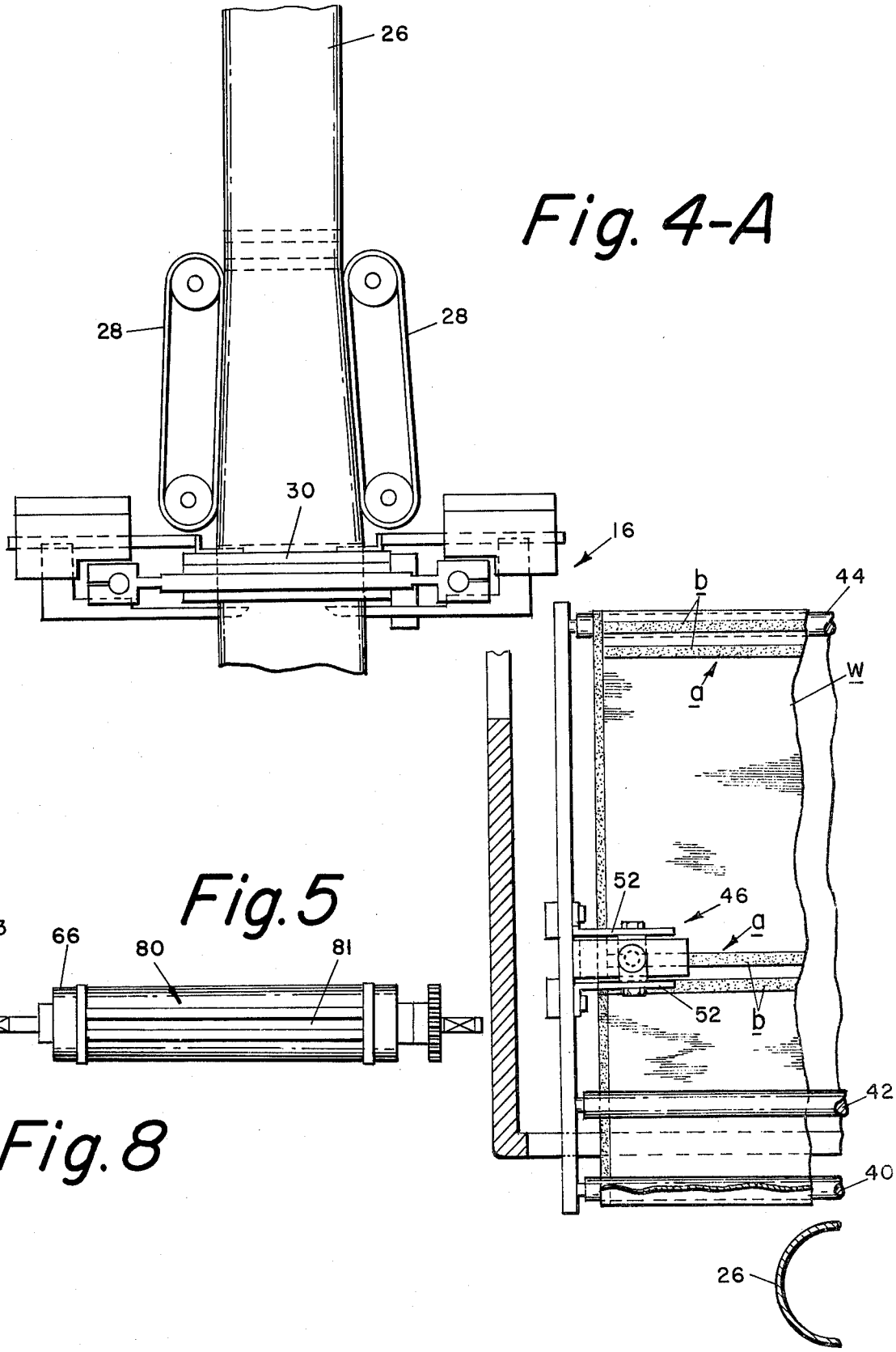
Fig. 4-A
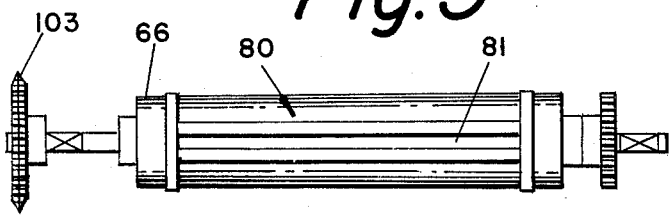
Fig. 5
Fig. 8

CONTROL FOR BAG MAKING MACHINE

BACKGROUND OF THE INVENTION

The making of a succession of bags from a web of sheet material by forming the web about a mandrel, advancing the web along the mandrel to sealing means to simultaneously form a seal transversely of the tube which constitutes in part the top of one bag and the bottom of the succeeding bag is old in the art. In accordance with the procedure followed by most bag manufacturers, heat sealable sheet material is employed and the sealing instrumentalities are provided with jaws containing heating elements which are brought together to form the seal. Cutting elements may also be embodied in the jaws or associated therewith to sever the tube within the area of the seal. Heat sealable material is expensive and so it is desirable to substitute therefor where the specific qualities of the heat sealable material are not required, sheet material which is not heat sealable and to apply a heat activatable adhesive thereto at intervals corresponding to the length of the bags to be made. Feeding the adhesive pre-printed web to the instrumentalities gives rise to problems because a very small error in the feed will multiply in a long length of web to displace the adhesive out of registration with the sealing instrumentalities with the result that no seal will be formed. Attempts to control the feed by printing indicia on the web at predetermined spacing in relation to the adhesive to control the feed by means of the indicia to intermittently advance the feed slightly more than the bag length and then slightly less than bag length to average out the error in spacing has been tried. The method is not completely successful and the control required is unusually complicated. The apparatus herein illustrated is designed to achieve control directly from the passage of the bars of adhesive relative to a detector and so without accumulation of errors which are inevitably introduced by the use of indicia.

SUMMARY OF THE INVENTION

Apparatus for making a continuous succession of bags from a web of sheet material which has printed thereon at intervals corresponding to the lengths of the bags to be made, transverse bands of heat-activatable adhesive comprising a mandrel about which the web is formed into a tube as it is advanced therealong, sealing instrumentalities situated beyond the mandrel in the direction of movement and feeding means associated with the mandrel for advancing the formed tube therealong toward the sealing instrumentalities. There is means for controlling the feeding means to stop the feed when a band of adhesive moves into registration with the sealing instrumentalities comprising detector means and cam means. The detector means is located upstream of the sealing means a distance corresponding to a whole number of bag lengths and is normally deactivated. There is a constantly driven cam shaft to which the cam means comprising first and second cams are mounted. The first cam means operates to activate the detector and the detector, in turn, upon ascertaining the adhesive band, stops the feeding means and the second cam means after a predetermined interval sufficient to permit the sealing means to function restarts the feeding means. The detector means as illustrated is a photosensitive unit comprising a light source and light cell placed at opposite sides of the web which, when sensitized, will produce a signal upon detecting a change in intensity of light passing through the web, or the two components comprising the light source and cell may be placed on the same side of the web so as to be operative by a change of intensity in reflected light. The feeding means is motor-driven and there is associated with the motor a clutch and brake. The signal from the detector disengages the clutch and applies the brake and the second cam means reengages the clutch and disables the brake. There is means preceding the photoelectric means for delivering the web to the photoelectric means at a slightly faster rate than it is used up so as to provide a predetermined amount of slack ahead of the photoelectric means and there is means for detecting the amount of slack and if this increases beyond a predetermined amount, to stop the feed of the web and when the slack is taken up, to restore the feed. The apparatus also includes an applicator for applying adhesive to the web at predetermined intervals corresponding to the lengths of the bags to be made, the applicator being in the form of a roller having a cylindrical surface on which there are adhesive lands which receive the adhesive from a tray and which are rotated in timed relation to the forward movement of the web so as to apply the bands of adhesive to the web at intervals corresponding to the bag lengths. Each land is divided medially so that each band of adhesive comprises two narrow, parallel strips of adhesive with a gap between them which is devoid of adhesive. The web is held against the applicator roll by a pressure roll and there is also means operable by the slack detector when it stops the feed to retract the pressure applying roll.

The invention will now be described in greater detail with reference to the accompanying drawings, wherein:

FIG. 4A is an enlarged front elevation of the sealing and severing means;

FIG. 5 is a fragmentary top view showing one location of the detector by means of which the feed is controlled;

FIG. 8 is a plan view of the applicator roll; and

Figure 9:
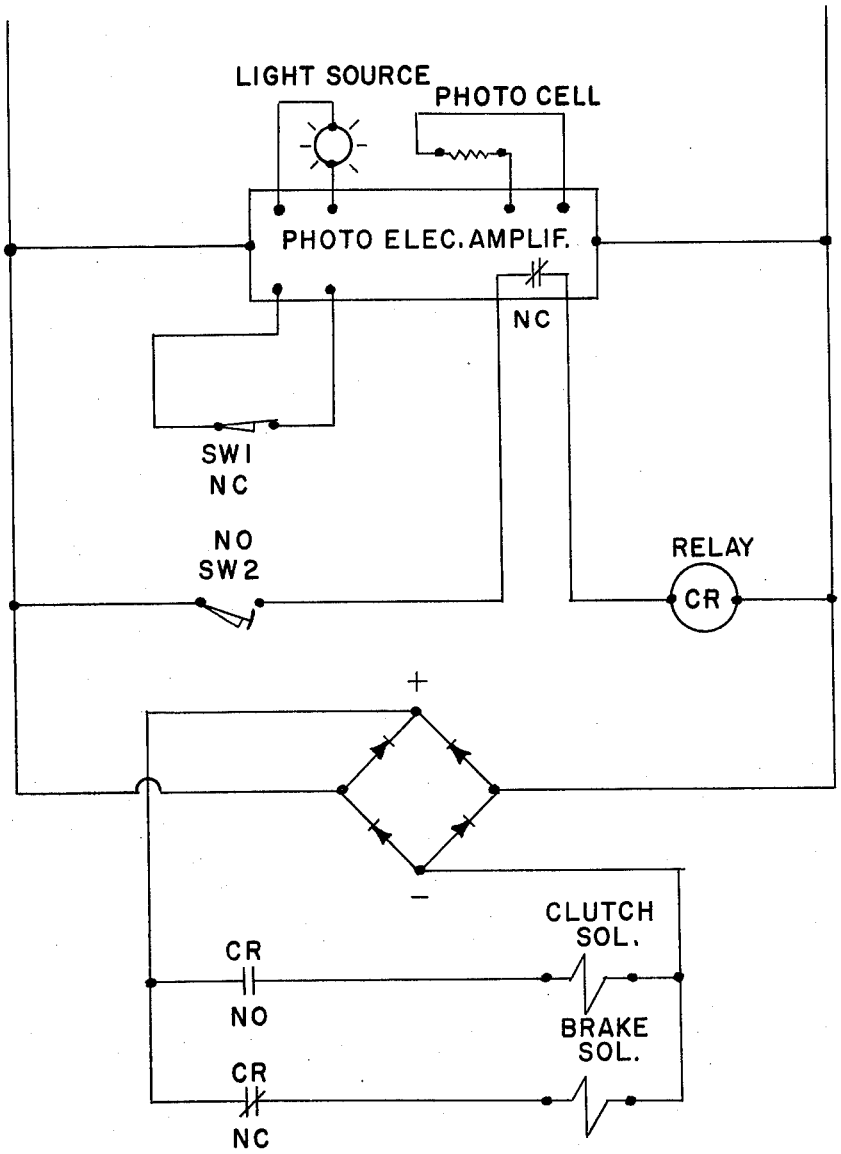

FIG. 9 diagrammatically shows the photoelectric control circuit.

As herein illustrated, the invention is described with specific reference to a vertical type bag forming, filling, sealing and severing operation. However, it is to be understood that the invention, as will be hereinafter described, is equally applicable to a horizontally arranged apparatus or an inclined apparatus and that it is applicable to formation of the bags without filling or with filling, without severing or with filling and severing. A vertical machine in which a web of sheet material is formed into bags on a hollow mandrel, filled, sealed and severed and provided with means for controlling the feed of the web of sheet material which is being formed into bags is shown, for example, in the patent to Eaton U.S. Pat. No. 2,636,730. In that machine, the web of sheet material is comprised of a thermoplastic material which can be heat sealed by means of sealing jaws brought together in engagement with the web after it has been formed into a tube to seal the tube transversely in such a way as to provide the top of one bag and the bottom of a succeeding bag, whereupon the sealed area is severed midway between its opposite edges. The use of a material which is heat sealable is expensive and there are many instances where it is desirable for the sake of economy and where the characteristics of a heat sealable material are not required to use a non-heat sealable sheet material and to apply thereto at intervals corresponding to the lengths of the bags to be made, a heat activatable adhesive. In long lengths of webbing, thus prepared, it is difficult to insure registration of the adhesive coated areas with the heat sealing instrumentalities because of creep, inaccuracy in the spacing of indicia, expansion and contraction of the web itself due to atmospheric conditions and the like and this persists even through the web may be provided with printed indicia for the purpose of activating a detector control feed. It is the purpose of this invention to overcome the aforesaid problems.

Figure 1:
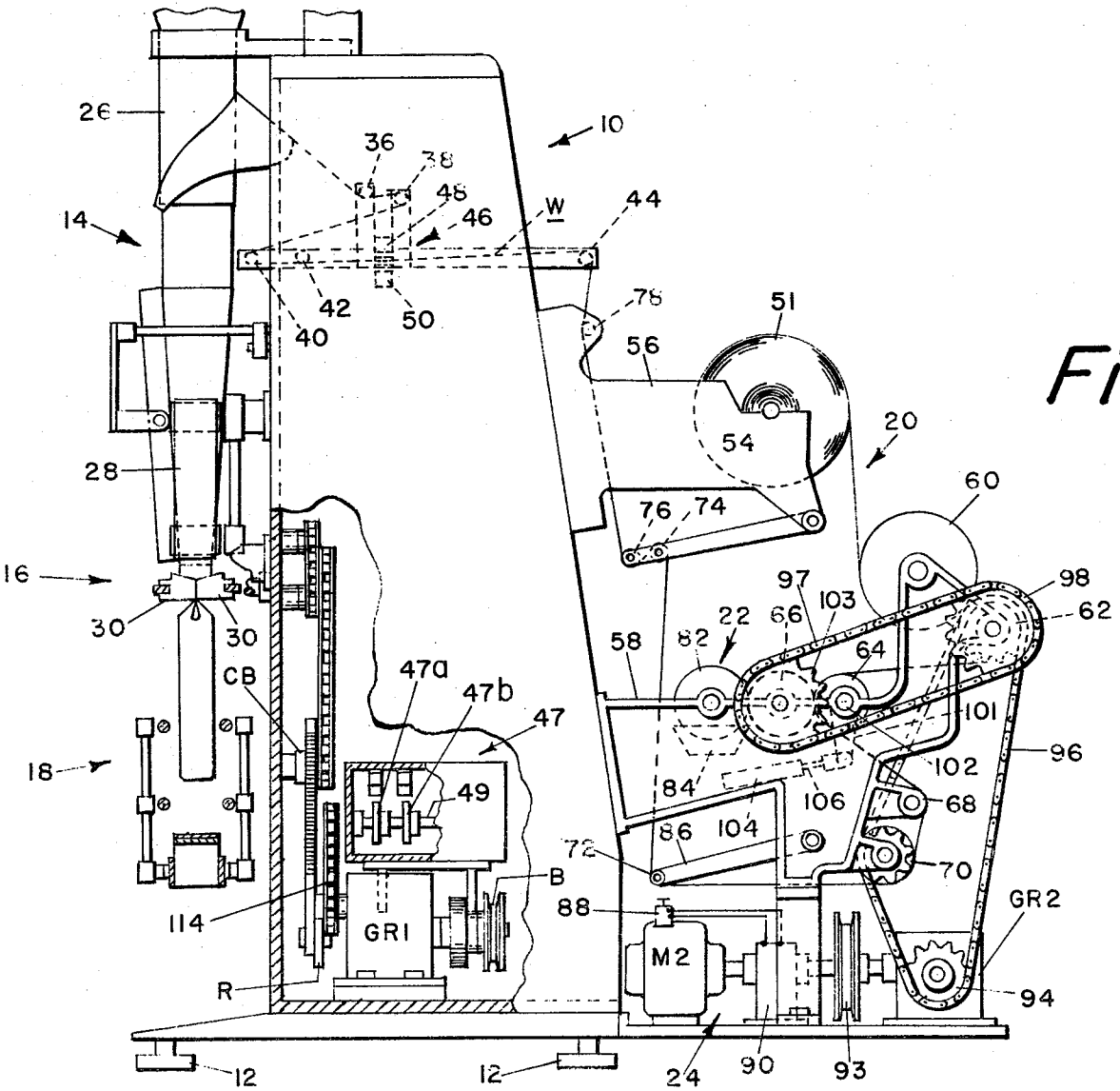
FIG. 1 is a side elevation of a vertical bag forming apparatus where the bags are formed with portions in section and with portions of the filling hopper omitted.

Referring now specifically to the drawings, FIG. 1, the apparatus comprises a standing frame 10 which stands upright on adjustable pads 12 at its base. At the front side of the frame, there are mounted bag forming means 14, sealing and severing means 16 and means 18 for receiving the severed bags and transporting them to a place for deposit in containers. At the rear side of the frame, there are mounted means 20 for delivering a web of sheet material to the tube forming means including adhesive applying means 22 and driving means 24.

Figure 2:
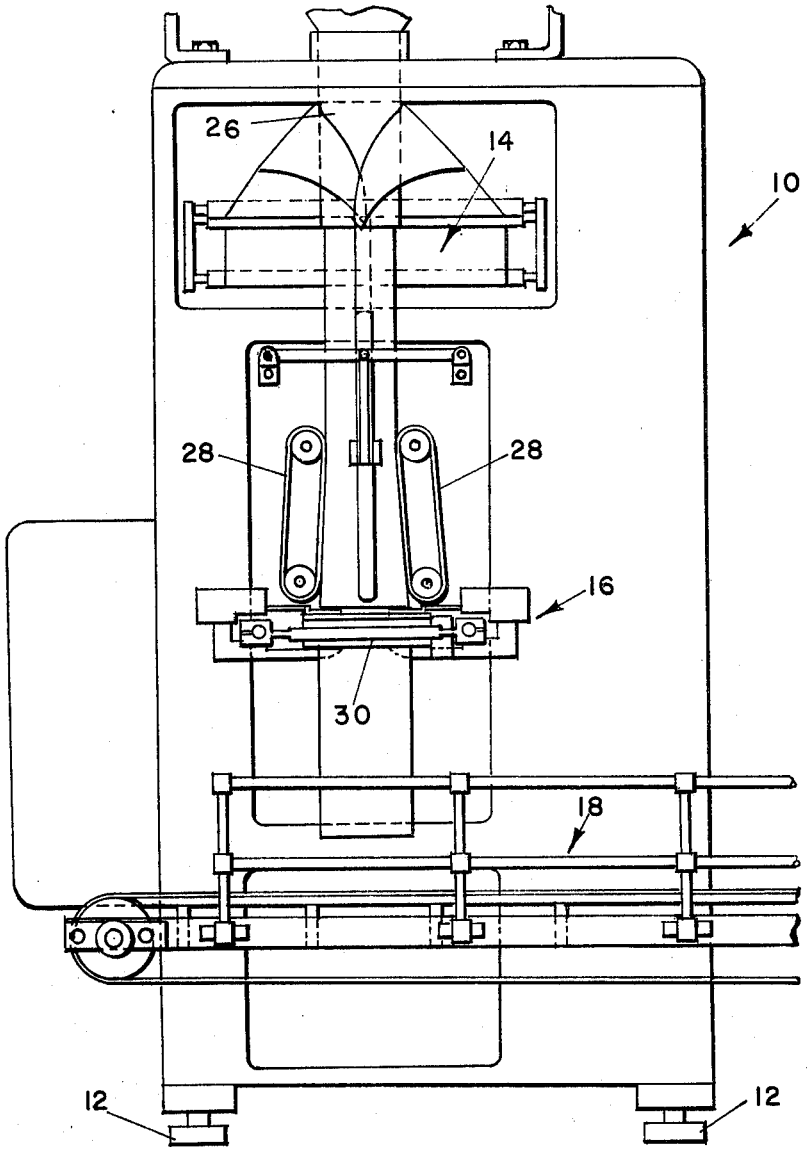
FIG. 2 is a front view of the apparatus shown in FIG. 1.
Figure 4:
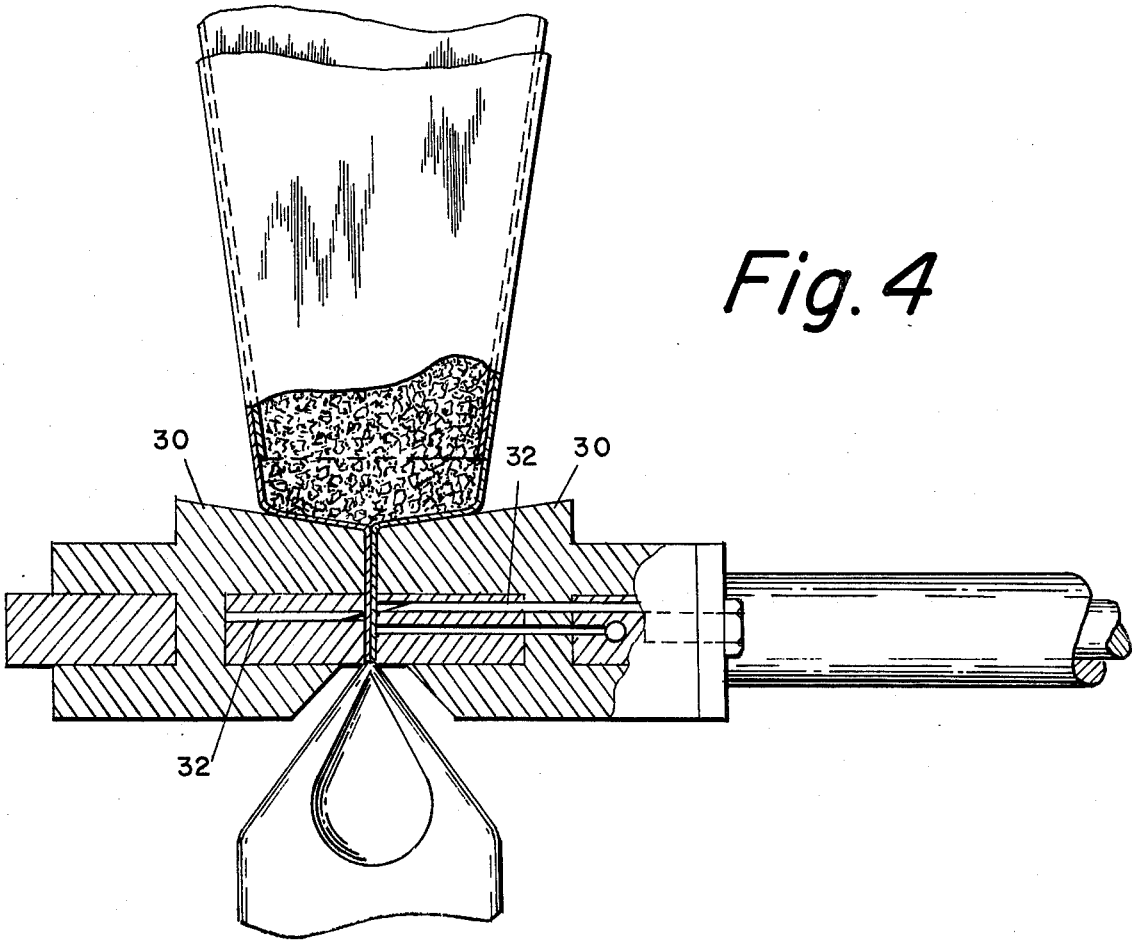
FIG. 4 is an enlarged fragmentary section showing sealing and severing means.

Referring to FIGS. 1 and 2, the tube forming means comprises a vertically supported hollow mandrel 26 about which the web is wrapped in conventional manner and drawn downwardly thereon with its opposite edges overlapping by means of a pair of endless belts 28—28 arranged at opposite sides of the mandrel so that by frictional engagement with the formed tube, the latter can be moved without slippage. The sealing means comprises a pair of transversely arranged horizontally reciprocable opposed jaws 30—30, FIG. 4, reciprocal toward and from each other for engagement with the front and back side of the tube to press them together to seal a narrow length of the tube. The jaws have a vertical depth which is sufficient to form a sealed area which is adapted to be severed intermediate its upper and lower boundaries to form a seal at the lower end of the bag above the jaws and a seal at the upper end of the bag below the jaws. The severing means comprises cutters 32—32 contained within the faces of the jaws and is operable following sealing to sever the sealed area.

The construction and operation of the sealing jaws and cutters are more fully described in application Ser. No. 527,808, filed Nov. 27, 1974, and so need not be referred to further herein. In the aforesaid machine, the bag forming material was comprised of a self-sealing material so that the sealing jaws, by engagement with the front and back sides of the tube, brought them together and effected a suitable seal. In accordance with this invention, the bags are comprised of a material which is not self-sealing, but which has at intervals corresponding to the bags lengths, transverse bands of a heat activatable adhesive *a*, FIG. 5, and so it is essential that the bag forming tube be delivered by the feeding means 28—28 to the sealing jaws 30—30 in such a way that the band of adhesive which is to be activated by the heat sealing jaws will always be into exact registration with the heat sealing jaws.

Figure 6:
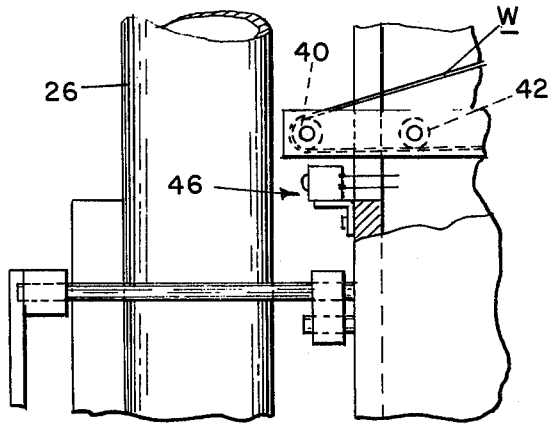
FIG. 6 is a fragmentary side elevation showing another possible location of the control by means of which the feed may be controlled.

Control of the feeding means 28—28 for delivering a bag length of the tube to the heat sealing jaws in such a way that a band of adhesive will always be in registration with the sealing jaws is accomplished by means of a detector 46, FIGS. 1 and 5, and cam means 47 comprising first and second cams 47*a* and 47*b*. The detector 46 is supported on the frame by suitable brackets 52—52 along the path of travel of the web and/or the tube at a distance from the sealing jaws which corresponds to one or more whole bag lengths and as herein illustrated, the web *w* is delivered to the mandrel from the rear side of the frame from a suitable supply as will hereinafter be described over a series of guide rolls 36, 38, 40, 42 and 44, FIG. 1. Between the guide rolls 40 and 44, there is a horizontal length of web which provides a convenient place for positioning of the detector 46. The detector as illustrated comprises a light 48 and a cell 50 located on opposite sides of the path of travel of the web. Alternatively, the detector may be placed adjacent the rear side of the mandrel so as to detect the bands of adhesive after the web has been formed into a tube as shown in FIG. 6. When thus locating the detector so that the light source and cell are located at the same side of the web, a change in intensity of the reflected beam from the light source activates the cell.

Because of the face that most adhesives are relatively transparent and the sensitivity may be such that the web itself might affect is actuation, it is desirable to introduce a coloring into the adhesive by adding a vegetable or other acceptable coloring material to the glue mix.

The web of sheet material *w* is delivered to the mandrel over the aforesaid guide rolls, 36, 38, 40, 42 and 44 from a bolt 51 wound on a spindle 54 and supported by means of the protruding ends of the spindle 54 on transversely spaced bracket plates 56—56 secured to the rear side of the frame. Below the bracket plates 56—56, there are bracket arms 58—58 which support a pair of feed rolls 60, 62 between which the web is drawn and delivered over a pressure applying roll 64 in surface engagement with an adhesive applying roll 66. From the adhesive applying roll, the web passes over guide rolls 68, 70, 72, 74, 76 and 78 to the guide roll 44.

The surface of the applicator roll 66 has on it at peripherally spaced intervals corresponding to the bag lengths desired, axially disposed lands 80 to which adhesive is supplied and which is transferred to the surface of the web as the latter is held engaged therewith by the pressure applying roll 64. Adhesive is supplied to the surface of the applicator roll by means of a doctor roll 82 supported with its lower side within a receptacle 84 containing a hot melt adhesive. An adhesive is employed which will set up quickly so as not to become deposited on the guide rolls.

Figure 3:
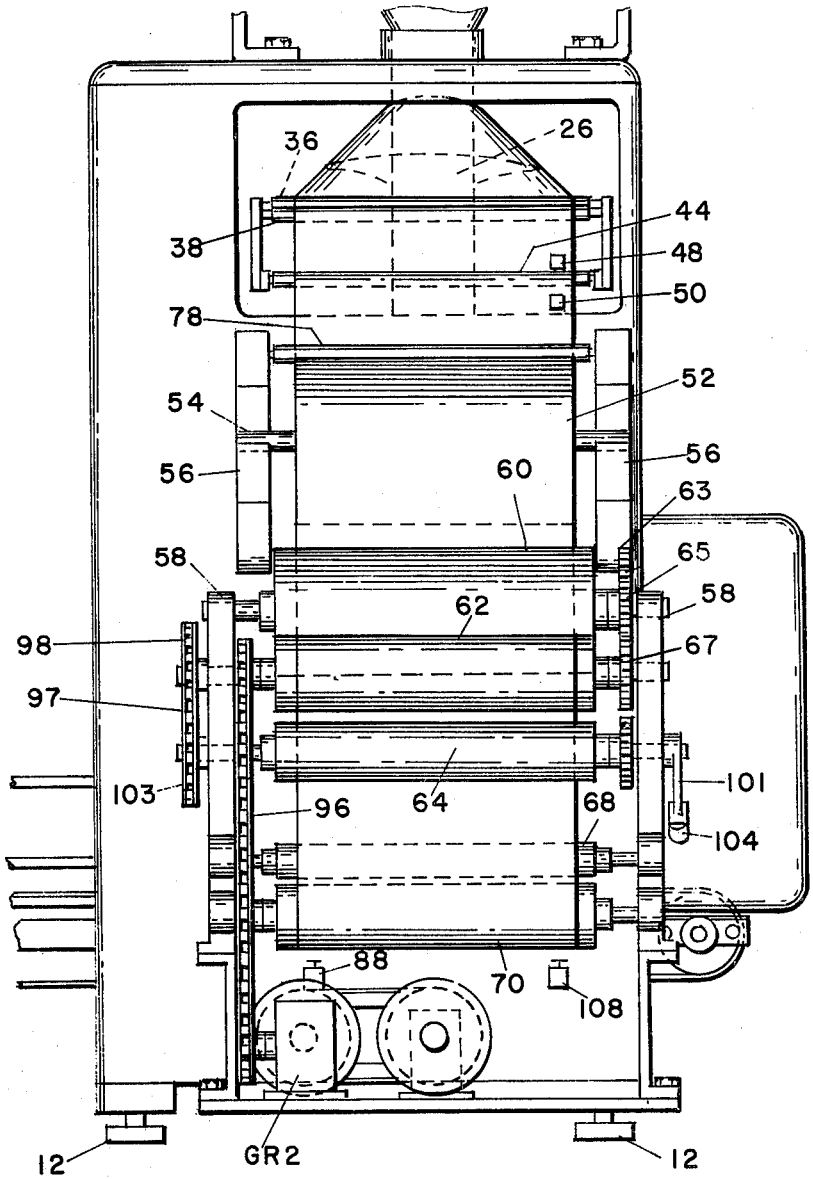
FIG. 3 is a rear view of the apparatus shown in FIG. 1.

In order that there always be a sufficient length of tubular material on the mandrel to be fed to the sealing jaws, it is desirable to supply a slight excess of the web to the mandrel. This is done by rotating the feed rolls 60, 62 so that a certain amount of slack is always maintained between the roll 70 and the roll 44. It is desirable, however, that the slack should not become excessive and so the guide roll 72 is supported at the distal end of a pair of arms 86—86 so that, as the slack increases, the weight of the arm 86—86 will depress the roll 72 into engagement which a switch 88 which, in turn, actuates an electric clutch 90 to stop the feed roll. The electric clutch provides the driving connection between a motor M2 and a drive sprocket 94 connected to a gear reduction unit GR2. The latter, in turn, driving the feed roll 62 by way of a chain 96 entrained about the sprocket 94 and about a sprocket 98 fastened to the shaft of the feed roll 62. The feed roll 60 is driven by a gear 63 fixed to its shaft, an idler 65, and a gear 67 fixed to the shaft of the feed roll 62. As soon as the slack is taken up to an extent which is acceptable, the guide roll 72 is lifted away from the switch 88 and the drive is thus restored. While the feed rolls are at a standstill, the applicator roll 66 which is hot could burn the web and so it is desirable to retract the pressure roll 64 during this period to prevent pressing of the web against the adhesive applying roll. For this purpose, the pressure roll 64 is mounted on a shaft 102, the ends of which are journaled in eccentric bearings so that the shaft and, hence, the pressure applying roll 64 may be rocked away from the adhesive applying roll about the axis of the shaft 102. Rocking of the pressure applying roll away from the adhesive applying roll is provided for by a cylinder 104 containing a piston rod 106, the protruding end of which is connected to an arm 101 fixed to one end of the shaft 102. By supplying pressure to the cylinder 104, the rod may be retracted to rock the pressure roll away from the adhesive applying roll. By supplying pressure in the opposite direction, it may be returned into engagement with the pressure applying roll. A switch 108, FIG. 3, operable by the descent of the guide roll 72 into engagement with the switch 88 operates simultaneously to supply pressure to the cylinder 104. The adhesive roll 66 is driven by a chain 97 entrained about a sprocket 101 fast to the shaft of the roll 62 and a sprocket 103 fast to the shaft of the adhesive roll.

As herein illustrated, FIG. 8, the adhesive printing lands 80 are divided medially lengthwise of the applicator roll so that there is a gap 81 midway between the opposite longitudinal edges of each land. Thus, the applicator roll applies the bands of adhesive *a* in the form of spaced pairs of stripes *b—b*, FIG. 5, of adhesive with a gap therebetween which is uncoated. The reason for this is to provide an uncoated area at the place where the tube is to be severed.

Figure 7:
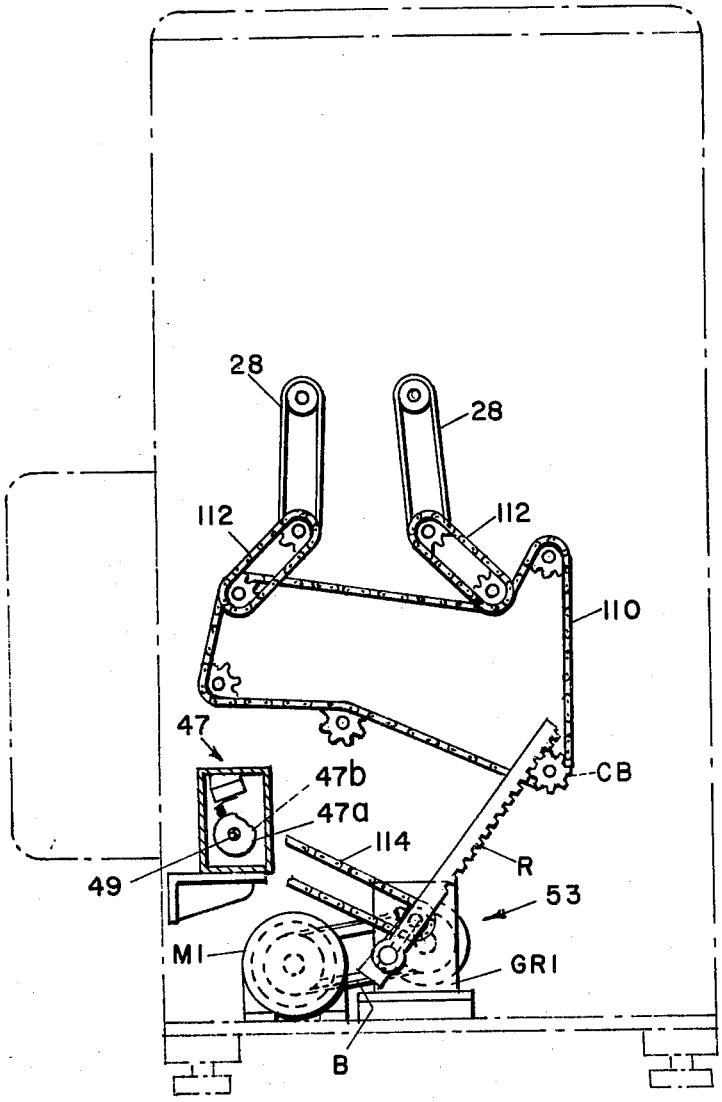
FIG. 7 is a view of the drive for the feed belt and for the cam shaft.

In operation, the sheet material is drawn off the bolt 51 by the rolls 60, 62 which deliver it to the applicator roll 66 for application of adhesive transversely of the web at intervals corresponding to the length of the bags to be made, whereupon the web travels around several guide rolls referred to the mandrel where it is formed into a tube and drawn downwardly thereon by the endless feeding belts in steps of one bag length to present a portion of the tube upon which the adhesive is applied in registration with the sealing jaws. The drive for the endless feed belts is designed to stop the feed with a band of adhesive in registration with the sealing jaws when the detector 46 detects the presence of a band of adhesive at a distance from the adhesive jaws which corresponds to a whole number of bag lengths, preferably not more than five or six bag lengths distance from the heat sealing jaws. The distance may be shorter but not less than a single bag's length. The drive for the feed belts 28—28 as shown in FIGS. 1 and 7 comprises a motor M1, a gear reducer unit GR1 connected thereto by a belt B, a rack R pivotally connected to an eccentric driven by the gear reducer, a one-way clutch C driven by the rack, a drive chain 110 and connector chains 112—112.

The apparatus as thus designed could be supplied with a precoated web of sheet material delivered directly to the guide rolls 44, 42 and 40 and to the mandrel if this were found to be desirable without need for pregluing apparatus as herein illustrated.

Control is achieved as hereinbefore related by the detector 46 and the first and second cams 47*a*, 47*b*, the latter being affixed to a continuously driven cam shaft 49 driven from the gear reducer GR1 by a chain 114. Under normal operating conditions, assuming that the feed belts are advancing the tube along the mandrel toward the sealing and severing means, the detector 46 is in a disabled condition. The reason for this is that the web is printed in the flat before being made into bags and if the detector were operative during the passage of this printed matter, the changes in transparency of the bag material would cause the detector to respond prematurely. To avoid this, the first cam 47*a* is timed in its relation to the forward feeding movement of the web and, hence, the successive bag lengths to render the detector sensitive just before the adhesive area reaches it so that it will only respond to the presence of a band of adhesive. The response of the sensitized detector 46 to the band of adhesive produces a signal which disengages the clutch, applies the brake and disables the detector so that the second stripe of adhesive has no further effect upon it. The detector remains disabled until just before the next adhesive band in succession reaches it, whereupon it is enabled by the second cam 47*b* which restarts the feed. During the disabled period, the sealing and severing operations take place.

Assuming that a sealing and severing operation has just been completed, the next cycle of operation is initiated by closing of switch SW2 which energizes relay CR. The normally closed contacts of relay CR deenergizes the brake solenoid and the normally open contacts of the relay CR energizes the clutch solenoid. The feed commences and the web of material is fed into the mandrel toward the sealing and severing means. As an adhesive band nears the detector 46, switch SW1 is opened by cam 47*a* to allow the photosensitive means to detect a change in light intensity. As the stripe *b* of a band *a* of adhesive on the web enters the light beam changing the light intensity at the detector, the normally closed photoelectric contacts open, thereby deenergizing relay coil CR. The normally open contact of relay CR deenergizes the clutch and the normally closed contact of relay CR deenergizes the brake. The web of material stops feeding onto the mandrel. Following the delay for sealing and severing, the cam 47*b* opens switch SW2, whereupon the switch contact SW1 closes to reset the circuit for the next machine cycle.

The control thus described minimizes any errors which might be introduced by reason of expansion and contraction in the web material and inaccuracy in applying indicia to a long length of webbing such as formerly used for controlling sealing an severing operations.

It should be understood that the present disclosure is for the purpose of illustration only and includes all modifications or improvements which fall within the scope of the appended claims.

I claim:

1. In a bag-making machine wherein a web of material is delivered to a mandrel for forming into a tube and from thence to a sealing means for activating an adhesive on the web which is printed thereon in the form of longitudinally spaced parallel bands of adhesive extending transversely of the web at intervals corresponding to the bag lengths to be formed, each band comprising two narrow strips of adhesive between which there is a gap devoid of adhesive, means for forming the web into a tube, feeding means, means for advancing the tube to the sealing means for activating the band of adhesive to simultaneously form the top of one bag and the bottom of the next, photosensitive means upstream of the sealing means a distance corresponding to a predetermined whole number of bag lengths, first and second switch means, a cam shaft, first and second cams on the cam shaft arranged, respectively, to open the first switch means and, by opening of the first switch means, to disable the feeding means and thereafter to open the second switch means and, by opening of said second switch means, to enable the feeding means, said cam means being sufficiently spaced apart such that the photosensitive means is sensitive only to said first strip of each band of adhesive.

2. The apparatus according to claim 1 wherein the motor driven feed means includes a clutch and brake, the photosensitive means operates to disengage the clutch and apply the brake, and the second cam means operates to disable the brake and reengage the clutch.

3. The apparatus according to claim 2 wherein the first and second cams are affixed to a cam shaft and there is means for driving the cam shaft continuously.

4. The apparatus according to claim 1 wherein the adhesive is applied to the web at intervals corresponding to the bag lengths in the form of longitudinally spaced parallel bands of adhesive extended transversely of the web.

5. The apparatus according to claim 4 wherein the bands of adhesive are divided intermediate their transverse boundaries by transverse gaps such that the tube may be severed at the gaps.

6. Apparatus for making a continuous succession of bags from a web of sheet material comprising an applicator, means for advancing the web relative to the applicator to receive therefrom at predetermined intervals a transverse band of heat-activatable adhesive, a mandrel toward which the adhesive-coated web is advanced, means for forming the web into a tube about the mandrel, sealing instrumentalities located beyond the mandrel in the direction of feed tube along the mandrel, feeding means associated with the mandrel for advancing the tube therealong toward the sealing instrumentalities, a detector arranged to detect the band of adhesive on the web, said detector beng situated along the path of movement of the web at a place distant from the sealing instrumentalities which correponds to a whole number of bag lengths as determined by the distance between successive bands of adhesive, said means for advancing the web toward the mandrel advancing the web at a slightly faster rate than it is used up to provide slack therein, a dancer element responsive to the slack thus created, means operable by the dancer element to stop the feeding means for advancing the web and means operable by the dancer to disable the applicator.

7. Apparatus for making a continuous succession of bags from a web of sheet material comprising an applicator, means for advancing the web relative to the applicator, a rotatable pressure-applying element arranged parallel to the applicator for pressing the sheet material against the applicator to cause it to receive therefrom at predetermined intervals a transverse band of heat-activatable adhesive, a mandrel toward which the adhesive-coated web is advanced, means for forming the web into a tube about the mandrel, sealing instrumentalities located beyond the mandrel in the direction of movement of the tube along the mandrel, feeding means associated with the mandrel for advancing the tube therealong toward the sealing instrumentalities and a detector arranged to detect the bands of adhesive on the web, said detector being situated along the path of movement of the web at a place distant from the sealing instrumentalities which corresponds to a whole number of bag lengths as determined by the distance between successive bands of adhesive.

* * * * *